US009938802B2

(12) United States Patent
Sladic et al.

(10) Patent No.: US 9,938,802 B2
(45) Date of Patent: Apr. 10, 2018

(54) TEMPORARILY IMPERMEABLE SLEEVE FOR RUNNING A WELL COMPONENT IN HOLE

(71) Applicant: Weatherford Technology Holdings, LLC, Houston, TX (US)

(72) Inventors: John S. Sladic, Katy, TX (US); Floyd R. Simonds, Jersey Village, TX (US); Paul Day, Aberdeen (GB)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 15/014,256

(22) Filed: Feb. 3, 2016

(65) Prior Publication Data

US 2016/0222767 A1 Aug. 4, 2016

Related U.S. Application Data

(60) Provisional application No. 62/111,516, filed on Feb. 3, 2015.

(51) Int. Cl.
*E21B 43/08* (2006.01)

(52) U.S. Cl.
CPC ..... *E21B 43/086* (2013.01); *E21B 43/08* (2013.01)

(58) Field of Classification Search
CPC ..... E21B 43/08; E21B 43/086
See application file for complete search history.

(56) References Cited

U.S. PATENT DOCUMENTS

| | | | | |
|---|---|---|---|---|
| 5,126,105 | A * | 6/1992 | Runkle | B22F 3/04 419/30 |
| 5,310,000 | A | 5/1994 | Arterbury et al. | |
| 5,355,956 | A * | 10/1994 | Restarick | E21B 43/11 166/229 |
| 5,526,881 | A * | 6/1996 | Martin | B21C 37/15 166/205 |
| 6,394,185 | B1 | 5/2002 | Constien | |
| 6,719,051 | B2 * | 4/2004 | Hailey, Jr. | E21B 34/06 166/236 |
| 7,048,048 | B2 | 5/2006 | Nguyen et al. | |

(Continued)

FOREIGN PATENT DOCUMENTS

| | | | |
|---|---|---|---|
| GB | 2271132 | A | 4/1994 |
| WO | 2013/122566 | A1 | 8/2013 |

OTHER PUBLICATIONS

Int'l Search Report and Written Opinion in counterpart PCT Appl. PCT/US2016/016289, dated Jun. 2, 2016, 14-pgs.

*Primary Examiner* — Matthew R Buck
*Assistant Examiner* — Aaron L Lembo
(74) *Attorney, Agent, or Firm* — Blank Rome LLP

(57) ABSTRACT

An apparatus for installation in a borehole comprises a well component and a sleeve. The well component has a through-bore and is permeable to the borehole. For example, the well component can be a well screen having a perforated basepipe with a filter disposed thereabout or can be a liner defining a plurality of openings therein. The sleeve is disposed external to the well component. The sleeve is at least temporarily impermeable to obstruct the well component during run in the borehole and becomes permeable in response to an agent, such as a hydrochloric acid, a hydrofluoric acid, an acid stimulation, a wellbore fluid, or a drilling fluid, for example.

16 Claims, 12 Drawing Sheets

(56) References Cited

U.S. PATENT DOCUMENTS

| | | | |
|---|---|---|---|
| 7,360,593 | B2 | 4/2008 | Constien |
| 7,762,342 | B2 | 7/2010 | Richard et al. |
| 8,342,240 | B2 | 1/2013 | Richard et al. |
| 8,430,174 | B2 | 4/2013 | Holderman et al. |
| 8,490,690 | B2 | 7/2013 | Lopez |
| 2012/0067574 | A1 | 3/2012 | Lopez |

* cited by examiner

TEMPORARILY IMPERMEABLE SLEEVE FOR RUNNING A WELL COMPONENT IN HOLE

CROSS-REFERENCE TO RELATED APPLICATIONS

This application claims the benefit of U.S. Prov. Appl. 62/111,516, filed 3 Feb. 2015, which is incorporated herein by reference.

BACKGROUND OF THE DISCLOSURE

Production of hydrocarbons from loose, unconsolidated, and/or fractured formations often produces large volumes of particulates along with the formation fluids. These particulates can cause a variety of problems. For this reason, operators use stand-alone screens (or screens together with gravel packing of the screens) in the wellbore annulus as a common technique for controlling the production of such particulates. Fracturing the formation and using the screen to retain the frac sand as well as secondary sand retention is also a common technique.

To gravel pack a completion, a screen is lowered on a workstring into the wellbore and is placed adjacent the subterranean formation. Particulate material, collectively referred to as "gravel," and a carrier fluid are pumped as a slurry down the workstring. Eventually, the slurry can exit through a "cross-over" into the wellbore annulus formed between the screen and the wellbore.

The carrier liquid in the slurry normally flows into the formation and/or through the screen itself. However, the screen is sized to prevent the gravel from flowing through the screen. This results in the gravel being deposited in the annulus between the screen and the wellbore to form a gravel-pack around the screen. The gravel, in turn, is sized so that it forms a permeable mass that allows produced fluids to flow through the mass and into the screen but blocks the flow of particulates into the screen.

Other than wellscreens, downhole assemblies can use slotted or perforated liners, perforated tubulars, and other permeable well components. For example, a permeable mechanical tube is used to provide a continuous wellbore for produced well fluids in reservoirs with competent sand control. At times, operators desire to install or run in hole these types of permeable well components in an impermeable manner so that flow in/out of the component is prevented and pressure may be applied as part of fluid circulation or as required to initiate and terminate certain downhole operations.

Various techniques have been used to make such permeable well components be impermeable for run-in. In one technique, plugging is done on the permeable well component using wax, polymeric coatings, or dissolvable materials. After the plugged well component is run in hole, a reactive fluid is placed in or around the component, and the fluid reacts with the plugging material to unplug the component and make it permeable. For example, the reactive liquid is circulated to dissolve or otherwise make the component permeable and allow wellbore fluid to pass into the component and up the well.

Some general examples of approaches for temporary plugging components are disclosed in U.S. Pat. No. 6,394,185; U.S. Pat. No. 7,360,593; U.S. Pat. No. 7,762,342; U.S. Pat. No. 8,342,240; U.S. Pat. No. 8,430,174; and U.S. Pat. No. 8,490,690. For example, U.S. Pat. No. 8,490,690 discloses a wellscreen having plugs in the basepipe so that flow from the screen and drainage layer cannot enter the basepipe. An acid containing structure is positioned in the basepipe or in the drainage layer of the screen. When the structure is contacted by an aqueous fluid, flow through the sidewall of the wellscreen can be selectively permitted as the structure releases acid that dissolves the plugs.

For example, U.S. Pat. No. 7,360,593 discloses coating for a wellscreen that protects the screen from damage as it is inserted into the wellbore. Once in the well, released reactive material reacts with and degrades any potential plugging materials that may have accumulated, such as drill solids, filter cake, additives, drilling fluids, etc. The reactive material melts or dissolves a binder of the coatings.

Although the techniques for temporarily plugging a permeable well component may be effective in some cases, the problem is creating a cost effective well component that functions suitably in an impermeable state to provide the necessary mechanical properties and then in a permeable state to offer high-permeability and low pressure drop through the component for operations and use.

The subject matter of the present disclosure is directed to overcoming, or at least reducing the effects of, one or more of the problems set forth above.

SUMMARY OF THE DISCLOSURE

According to the present disclosure, an apparatus for installation in a borehole comprises a well component and a sleeve. The well component has a through-bore and is permeable to the borehole. For example, the well component can be a well screen having a perforated basepipe with a filter disposed thereabout or can be a liner defining a plurality of openings therein.

The sleeve is disposed external to the well component. The sleeve is at least temporarily impermeable to obstruct the well component during run in the borehole and becomes permeable in response to an agent, such as a hydrochloric acid, a hydrofluoric acid, an acid stimulation, a wellbore fluid, or a drilling fluid, for example.

In one embodiment, the sleeve can define a plurality of perforations therein and can have plugging material covering the perforations. The plugging material is removable from covering the perforations in response to the agent. For example, the plugging material can include a plurality of plugs affixed in the perforations. The plugging material can include an aluminum, a reactive metal, a dissolvable metal, a polymeric formulation, a polyglycolide, or a polyglycolic acid.

In another embodiment, the sleeve can be composed of a material being reactive to the agent. Again, the material of the sleeve can be an aluminum, a reactive metal, a dissolvable metal, a polymeric formulation, a polyglycolide, or a polyglycolic acid. The sleeve can become permeable in response to the agent selected from the group consisting of a hydrochloric acid, a hydrofluoric acid, an acid stimulation, a wellbore fluid, and a drilling fluid.

According to the present disclosure, a method is used for manufacturing a well component for installation in a borehole. A sheet of a first material is perforated with a plurality of perforations, and the perforations are covered with a second material reactive to an agent. The sheet is into an impermeable sleeve by welding one or more seams of the sheet, and the well component is at least temporarily obstructed with the impermeable sleeve by positioning the impermeable sleeve on the permeable component.

Perforating the sheet can involve forming the perforations by punching the sheet. Covering the perforations with the second material reactive to the agent can involve at least one of affixing plugs of the second material in the perforations, riveting or threading the plugs in the perforations; and filling the perforations with the second material.

Forming the sheet into the impermeable sleeve and positioning the impermeable sleeve on the well component can involve first forming the sheet into the impermeable sleeve and then slipping the impermeable sleeve on the well component or can involve forming the sheet into the impermeable sleeve while positioning the impermeable sleeve on the well component.

Covering the perforations with the second material reactive to the agent can involve at least one of covering the perforations before forming the sheet into the impermeable sleeve and covering the perforations after forming the sheet into the impermeable sleeve.

In an alternative, the method of manufacturing a well component for installation in a borehole can involve taking a sheet of a first material reactive to an agent. The sheet can be formed into an impermeable sleeve by welding one or more seams of the sheet. The well component can be obstructed at least temporarily with the impermeable sleeve by positioning the impermeable sleeve on the well component.

According to the present disclosure, an apparatus for installation in a borehole comprises a well component having a through-bore and defining one or more perforations permeable to the borehole. Plugging material is disposed in the one or more perforations. The plugging material obstructs the one or more perforations and makes the well component at least temporarily impermeable during run in the borehole. The plugging material is removable from the one or more perforations in response to an agent to make the well component permeable.

A method of manufacturing such a well component for installation in a borehole can involve forming the well component with a plurality of perforations. The well component is made at least temporarily impermeable for run-in by covering the perforations with a second material reactive to an agent. The well component is run in the borehole, and the well component is made permeable by reacting the second material to the agent.

The foregoing summary is not intended to summarize each potential embodiment or every aspect of the present disclosure.

BRIEF DESCRIPTION OF THE DRAWINGS

FIG. 1A illustrates a permeable well component of the present disclosure having impermeable plugs according to the present disclosure for protective run-in.

FIG. 1B illustrates a permeable well component of the present disclosure having an impermeable sleeve according to the present disclosure for protective run-in.

FIG. 1C illustrates a permeable well component of the present disclosure having another impermeable sleeve according to the present disclosure for protective run-in.

FIG. 3A illustrates a permeable well component of the present disclosure having an impermeable sleeve according to the present disclosure for protective run-in.

FIG. 3B illustrates another permeable well component of the present disclosure having another impermeable sleeve according to the present disclosure for protective run-in.

DETAILED DESCRIPTION OF THE DISCLOSURE

As noted above, operators desire at times to install or run in hole various types of permeable well components in an impermeable manner so that flow in/out of the component is prevented until the component is to be used for its purpose. Disclosed herein are devices and techniques for making such permeable well components at least temporarily impermeable. In general, the devices and techniques can be used on permeable well components, such as well screens, slotted or perforated liners, perforated tubulars, tubular components, and the like.

Figure 1A:
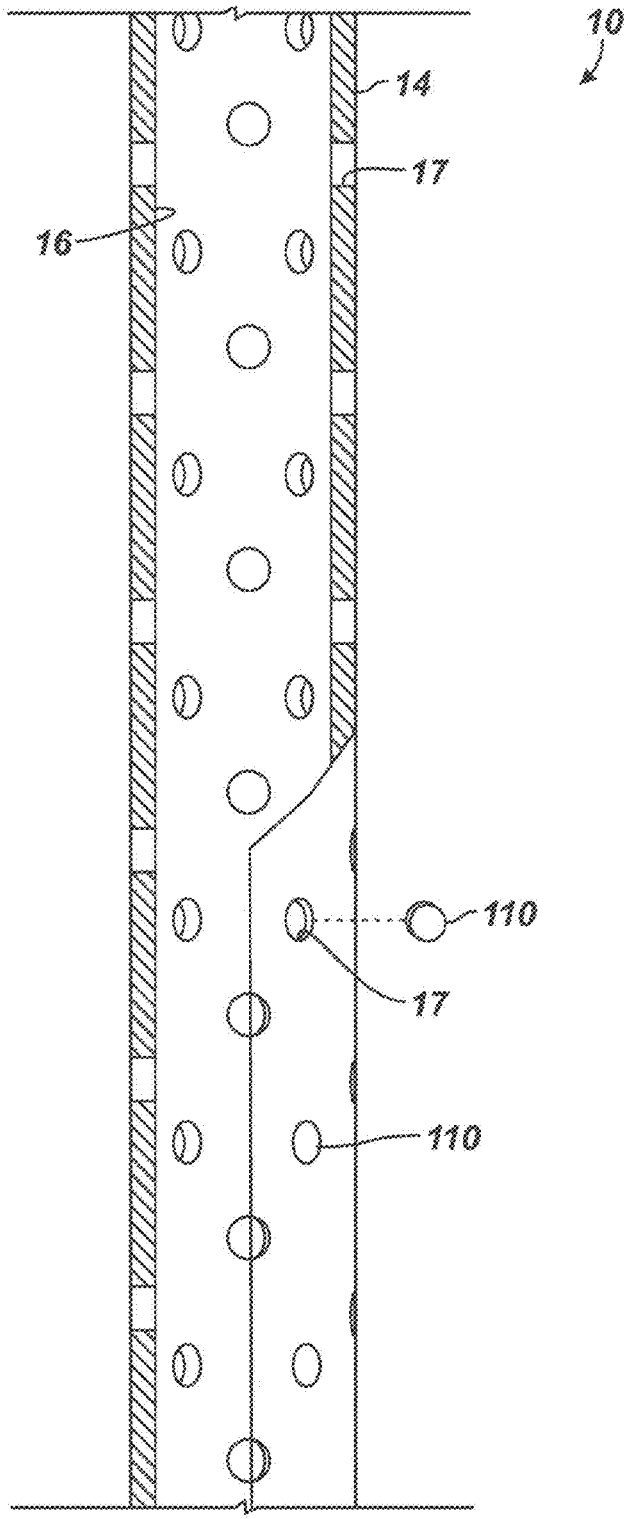

For example, FIG. 1A illustrates a permeable well component 10 of the present disclosure in the form of a perforated pipe 14, liner, or other tubular. A number of perforations 17 are defined in the pipe 14, permitting fluid communication of the through-bore 16 outside the pipe 14. To make the permeable pipe 14 temporarily impermeable for run-in or the like, plugging material in the form of a number of impermeable plugs 110, inserts, rivets, or the like according to the present disclosure are disposed in the perforations 17 for protective run-in. As will be appreciated, even though the perforations 17 are depicted as round openings, they can have any desired shape, even as elongated slots. In that sense, the plugs 110 can likewise have other shapes.

These plugs 110 can be affixed in the perforations 17 in a number of ways depending on the types of materials used. For example, the pipe 14 may be composed of a suitable stainless steel for downhole use, while the plugs 110 can be composed of aluminum or other metal that dissolves/reacts to a reagent, such as hydrochloric acid, hydrofluoric acid, or other reagents commonly used for acid stimulation. Alternatively, the plugs 110 can be composed of a polymeric formulation that dissolves/reacts to the reagent.

Furthermore, the reagent may be wellbore fluid itself, and the plugs 110 may be composed of a material, such as polyglycolide or polyglycolic acid (PGA) or the like, that dissolves/reacts to the wellbore fluid, such as drilling fluid or the like. In this sense, the plugs 110 may begin to dissolve/react while running in hole, but would preferably not make the well component 10 impermeable at least until the well component 10 is positioned. In other words, deployment may be time dependant, taking several hours after exposure for the well component 10 to be made permeable.

Either way, the plugs 110 can be threaded, tack welded, press fit, deposited, packed, or otherwise affixed into the perforations 17 in a number of ways. Once the pipe 14 has been positioned downhole, the pipe 14 can be made permeable by introducing a reagent downhole to dissolve or otherwise remove the plugs 110. At this point, the plugs 110 can dissolve, pop out, erode, or otherwise be removed from the perforations 17, and the pipe 14 can be used for its intended purpose.

Figure 1B:
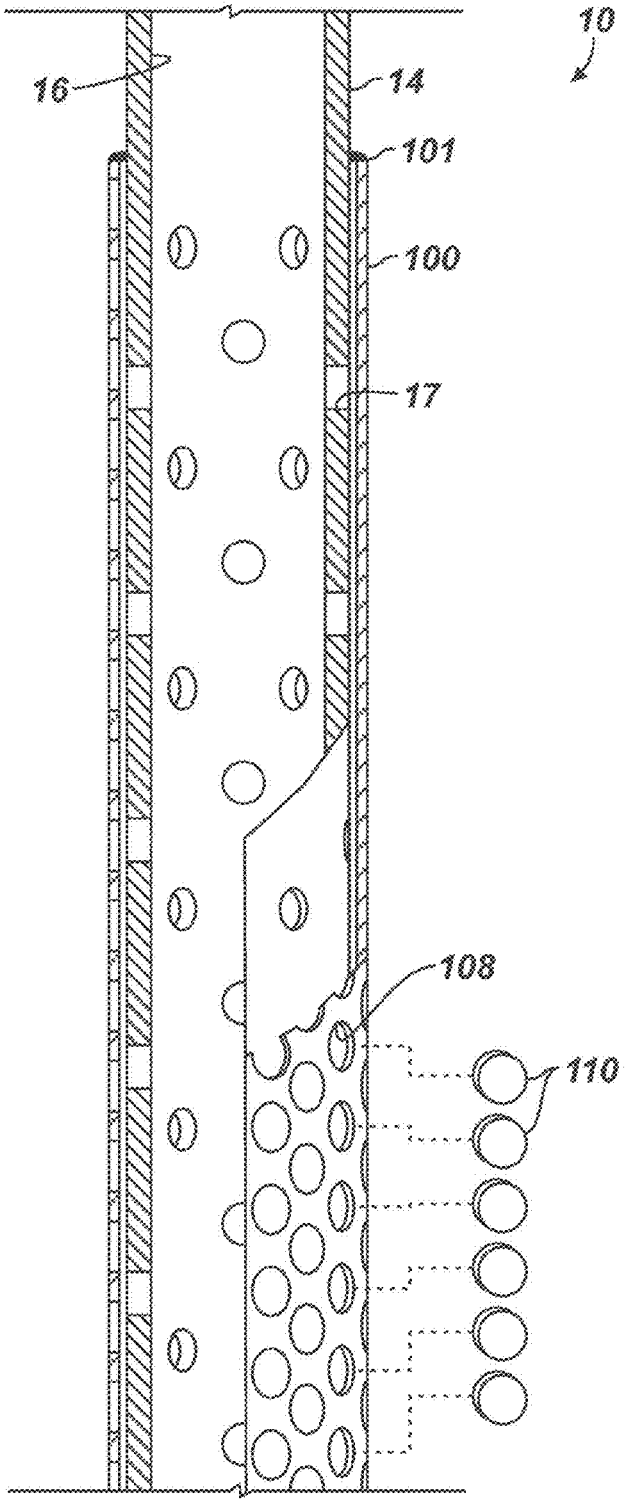

In another example, FIG. 1B illustrates a permeable well component 10 of the present disclosure in the form of a perforated pipe 14, liner, or other tubular. A number of perforations 17 are defined in the pipe 14, permitting fluid communication of the through-bore 16 outside the pipe 14. To makes the permeable pipe 14 temporarily impermeable for run-in or the like, an impermeable sleeve or shroud 100 according to the present disclosure is disposed about the pipe 14 for protective run-in.

Welding, brazing, threading, shrink fitting, using fixtures or end rings, or other techniques can be used to affix the sleeve 100 to the pipe 14 so that the sleeve 100 covers the perforations 17, which may not cover the entire extent of the pipe 14. For instance, ends (not shown) of the pipe 14 may be threaded for coupling to other sections of pipe so that portions of the ends may lack perforations 17, and ends 101 of the sleeve 100 can be welded to the exterior of the pipe 14 at these impermeable sections.

The sleeve 100 itself is perforated with a number of openings 108. Plugging material in the form of plugs 110, inserts, rivets, or the like are affixed in the openings 108 to make the perforated sleeve 100 impermeable. As will be appreciated, even though the openings 108 are depicted as round openings, they can have any desired shape, even as elongated slots. In that sense, the plugs 110 can likewise have other shapes. Moreover, the openings 108 need not be the same size, shape, or distribution as the perforations 17 in the pipe 14.

The plugs 110 can affix in a number of ways depending on the types of materials used. For example, the sleeve 100 may be composed of a suitable metal for downhole use, while the plugs 110 can be composed of aluminum or other metal that dissolves/reacts to a reagent, such as hydrochloric acid, hydrofluoric acid, or other reagents commonly used for acid stimulation. The sleeve 100 may also be composed of such a metal. Alternatively, the plugs 110 (as well as the sleeve 100) can be composed of a polymeric formulation that dissolves/reacts to the reagent.

Furthermore, the reagent may be wellbore fluid itself, and the plugs 110 (as well as the sleeve 100) may be composed of a material, such as polyglycolide or polyglycolic acid (PGA) or the like, that dissolves/reacts to the wellbore fluid, such as the drilling fluid or the like. In this sense, the plugs 110 may begin to dissolve/react while running in hole, but would preferably not make the well component 10 impermeable during run in at least until the well component 10 is positioned.

Either way, the plugs 110 can be threaded, tack welded, press fit, or otherwise affixed into the openings 108 in a number of ways. Once the pipe 14 has been positioned downhole, the pipe 14 can be made permeable by introducing a reagent downhole to dissolve or otherwise remove the plugs 110. Depending on the material of the sleeve 100, portions of the sleeve 100 may also dissolve or otherwise react with the reagent. At this point, the pipe 14 can be used for its intended purpose.

Figure 1C:
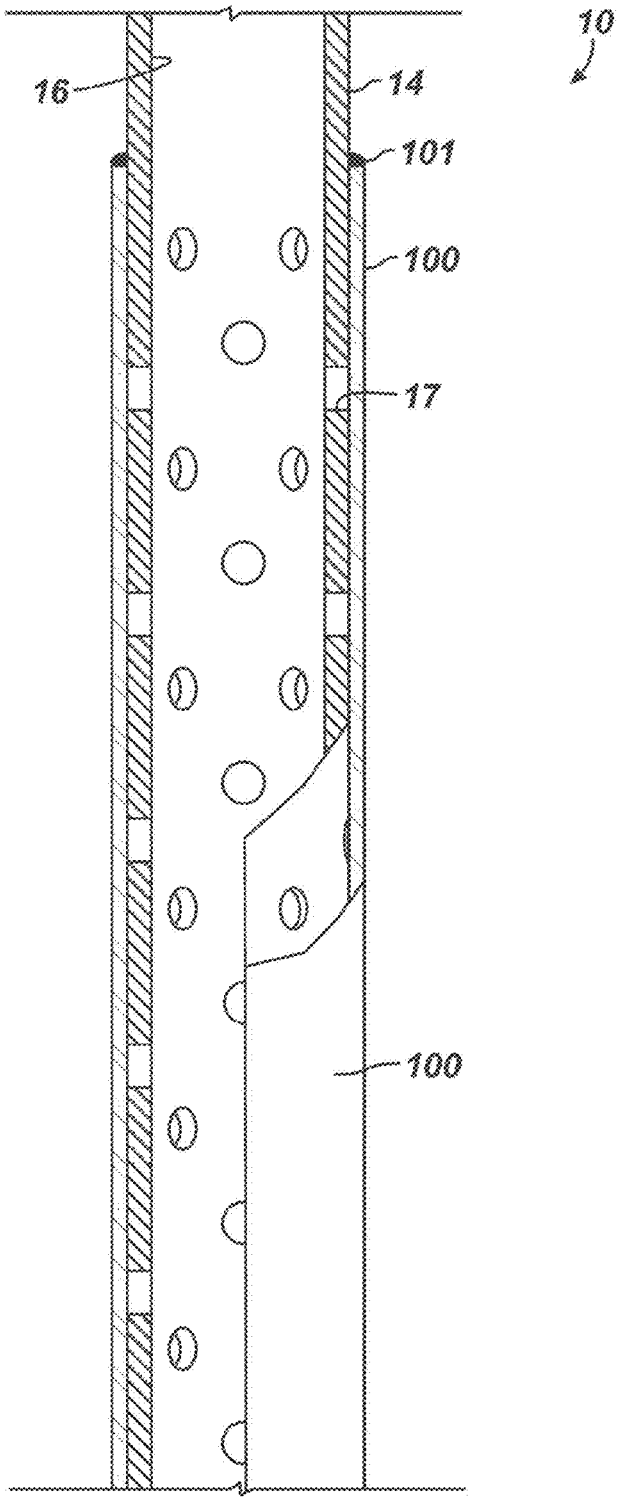

Although the sleeve 100 of FIG. 1B is a perforated cylinder, it could just as easily be a solid cylinder or even a coating disposed about the pipe 14. For example, FIG. 1C illustrates another permeable well component 10 in the form of a perforated pipe 14, liner, or other tubular. An impermeable sleeve 100 in the form of a shroud, coating, or the like according to the present disclosure for protective run-in is disposed on the exterior of the pipe 14 and covers the perforations 17. Welding, brazing, threading, shrink fitting, using fixtures or end rings, or other techniques can be used to affix the sleeve 100 to the pipe 14 so that the sleeve 100 covers the perforations 17, which may not cover the entire extent of the pipe 14. For instance, ends (not shown) of the pipe 14 may be threaded for coupling to other sections of pipe so that portions of the ends may lack perforations 17, and ends 101 of the sleeve 100 (when made of metal) can be welded to the exterior of the pipe 14. Alternatively, the sleeve 100 can be formed around the outside of the pipe 14 by welding a seam of rolled material, by shrink fitting a cylinder, by applying a coating, etc. to the pipe 14.

In any event, this sleeve 100, which is a solid cylinder, can react to an introduced reactive agent so that the sleeve 100 or at least portions thereof expose the perforations 17 in the pipe 14 for operations. For instance, the sleeve 100 may be composed of aluminum or other metal that dissolves/reacts to a reagent, such as hydrochloric acid, hydrofluoric acid, or other reagents commonly used for acid stimulation. Once the pipe 14 has been positioned downhole, the pipe 14 can be made permeable by introducing a reagent downhole to dissolve or otherwise remove portions of the sleeve 100 around the perforations 17. At this point, the pipe 14 can be used for its intended purpose.

Alternatively, the reagent may be wellbore fluid itself, and the sleeve 100 may be composed of a material, such as polyglycolide or polyglycolic acid (PGA) or the like, that dissolves/reacts to the wellbore fluid, such as the drilling fluid or the like. In this sense, the sleeve 100 may begin to dissolve/reach while running in hole, but would preferably not make the well component 10 impermeable during run in at least until the well component is positioned.

In previous examples, the well component 10 has been a perforated pipe 14, liner, or other tubular. As already noted above, other permeable well components can benefit from the disclosed sleeve 100, plugs 110, and techniques. For example, well screens with or without a protective shroud can benefit from the disclosed sleeve 100, plugs 110, and techniques.

As one particular example, FIGS. 2A-2D show examples of a well screen assembly 10 that can benefit from the disclosed devices and techniques. In the assembly 10, a first sand control device 12*a* is coupled to a second sand control device 12*b*, and each device 12*a-b* has basepipe joints 14 joined together to define a production bore 16. Screens 18*a-b* having filter media surround the basepipe joints 14 and are supported by ribs 19. Although shown as a wire-wrapped screen, other types of filter media known in the art can be used for the screens 18*a-b*.

The assembly 10 can be provided with shunt tubes 30*a-b*. The shunt tubes 30*a-b* are supported on the exterior of the screens 18*a-b* and provide an alternate flow path 32 to the main production bore 16. To provide fluid communication between the adjacent sand control devices 12*a-b*, jumper tubes 40 can be disposed between the shunt tubes 30*a-b*. In this way, the shunt tubes 30*a-b* and the jumper tubes 40 maintain the flow path 32 outside the length of the assembly 10, even if the borehole's annular space B is bridged, for example, by a loss of integrity in a part of the formation F.

Although shown with shunt tubes 30*a-b* and the like, the wellscreen assembly 10 need not include such alternative path devices.

Figure 2A:
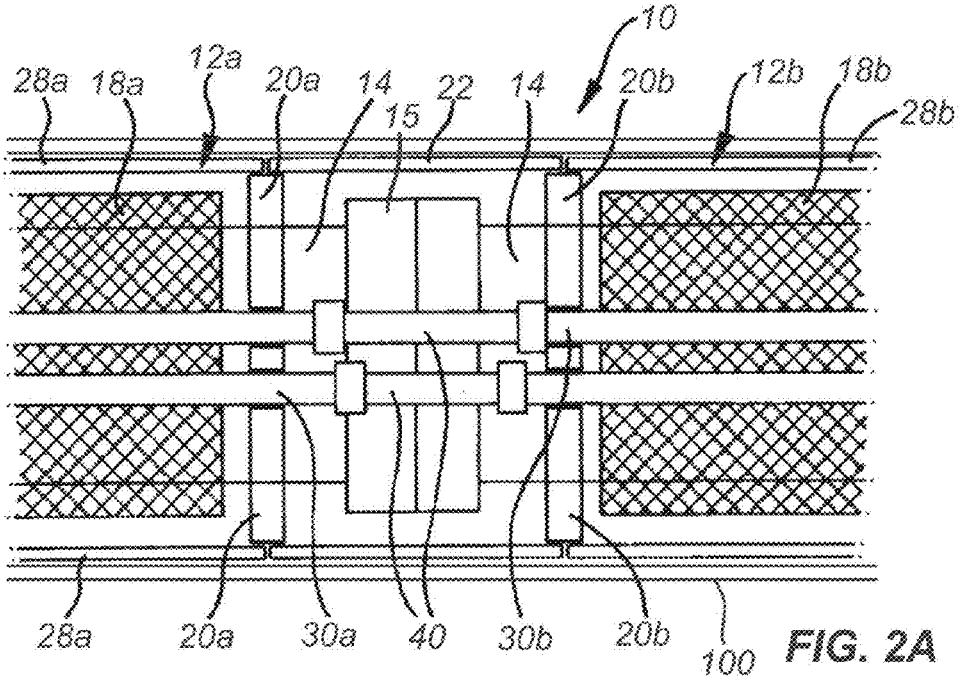
FIG. 2A illustrates a side view of a permeable well component in the form of a wellscreen assembly according to the present disclosure for an open hole.
Figure 2B:
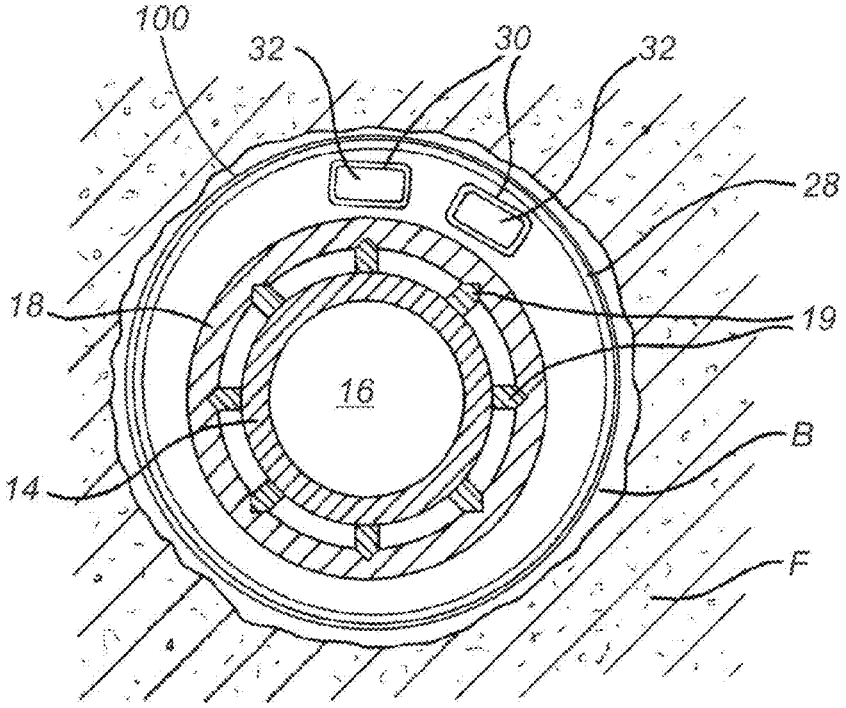
FIG. 2B illustrates an end view of the open hole wellscreen assembly of FIG. 2A.
Figure 2C:
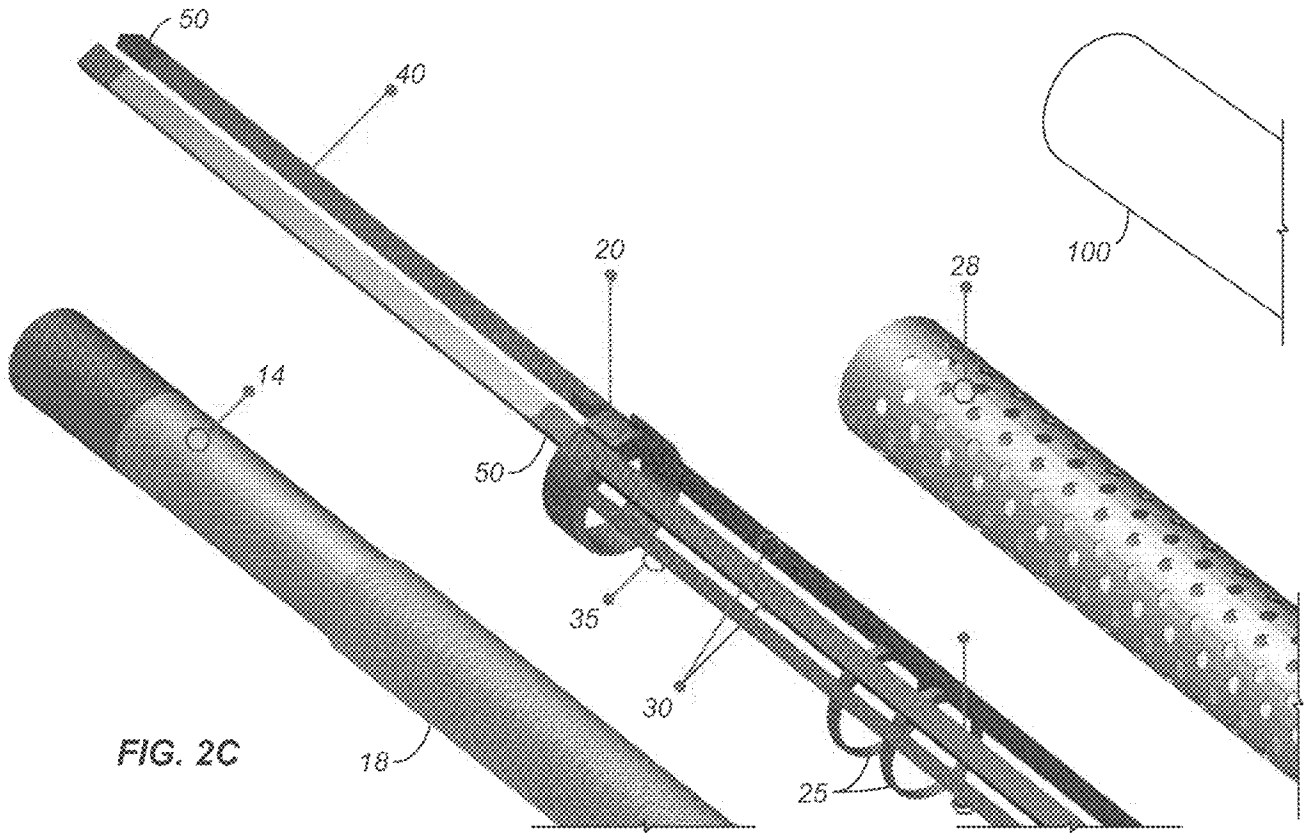
FIG. 2C illustrates an exploded view of the wellscreen assembly of FIG. 2A.
Figure 2D:
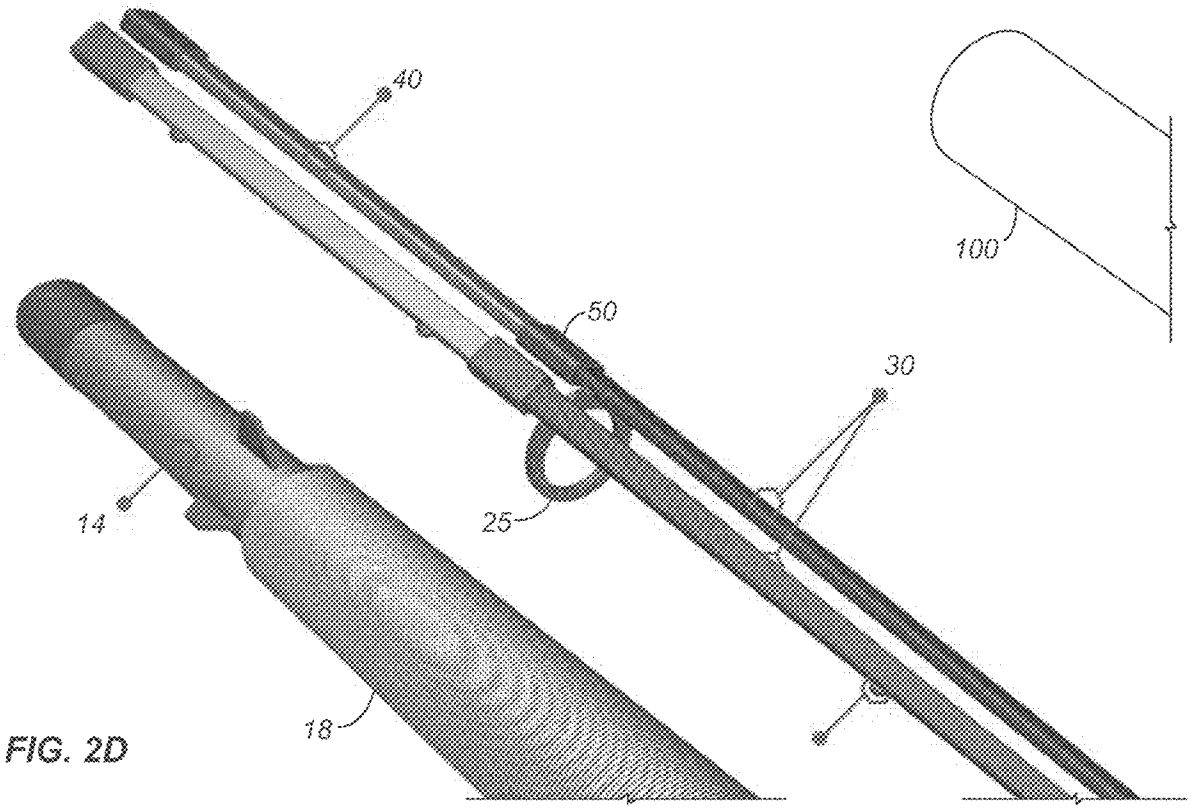
FIG. 2D illustrates an exploded view of a wellscreen assembly according to the present disclosure for a cased hole.

As shown in FIGS. 2A-2C, the assembly 10 can be configured for an open hole completion and may typically have main shrouds 28*a-b* that extend completely over the sand control devices 12*a-b* and provides a protective sleeve for the filter media and shunt tubes 30*a-b*. The shrouds 28*a-b* have apertures to allow for fluid flow. The main shrouds 28*a-b* terminate at the end rings 20*a-b*, which supports an end of the shroud 28*a-b* and have passages for the ends of the shunt tubes 30*a-b*. For a cased hole completion as shown in the example of FIG. 2D, the assembly 10 may lack a shroud.

As can be seen, the permeable well component 10 for installation in a borehole is a tubular body having a throughbore 16. The component 10 is permeable to the borehole and can be a well screen, slotted liner, perforated liner, a permeable tubular, or other well component. To install or run the permeable well component 10 in an impermeable manner in hole so that flow in/out of the component 10 is prevented until the component 10 is to be used for its purpose, a device or sleeve 100 disposed external to the component 10 is temporarily impermeable. In use, the sleeve 100 is at least temporarily impermeable to obstruct the permeable nature of the component 10 during run in the borehole (i.e., obstruct flow in/out of the component 10 through the screen, slotted liners, perforated shroud, etc.). Then, in response to an agent introduced in the borehole, the sleeve 100 becomes permeable, allowing the permeable component 10 to be used for fluid communication for gravel packing, treatment, completion, etc.

For example, the component 10 can be a tubular body in the form of a well screen having a basepipe 14 with a filter 18 disposed thereabout. Alternatively, the component 10 can be or can include a liner, a shroud, or the like defining a plurality of openings therein.

In one embodiment, the sleeve 100 is a shroud defining a plurality of perforations therein and having plugging material covering the perforations. The plugging material is removable from covering the perforations in response to the agent. For example, the plugging material can include a plurality of plugs, buttons, rivets, etc. affixed in the perforations.

Figure 3A:
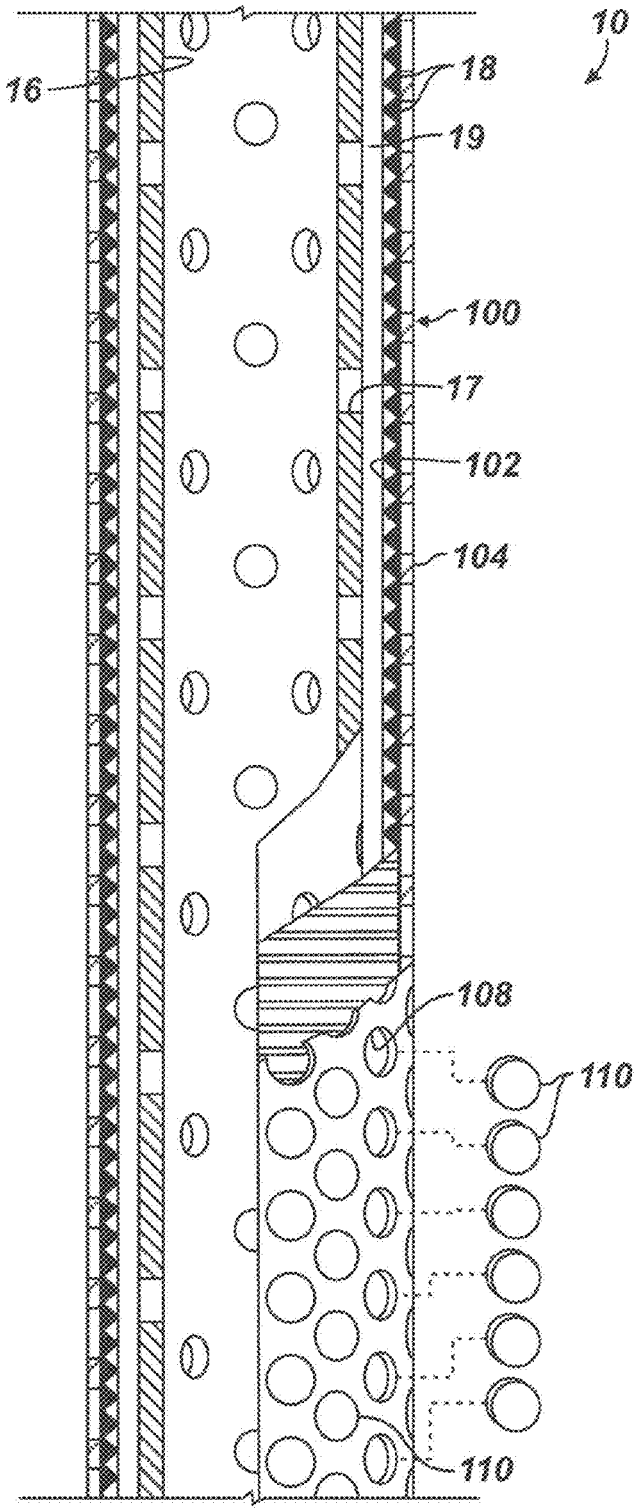

As an example, FIG. 3A illustrates a permeable well component 10 of the present disclosure having an impermeable sleeve or shroud 100 according to the present disclosure for protective run-in. As shown, the well component 10 is a tubular body in the form of a well screen having a basepipe 14 with openings 17 communicating with the basepipe's bore 16. Wire of a wire-wrapped screen 18 is disposed about ribs 19 defining a drainage layer on the outside of the basepipe 14.

The assembly 10 includes an impermeable sleeve 100 as an additional component to the downhole component, such as wellscreen, a pre-drilled liner, or a slotted liner. In this case, the sleeve 100 is positioned between the wellbore's open hole or casing and the downhole component 10 (e.g., wellscreen, pre-drilled liner, or slotted liner). In particular, the sleeve 100 is disposed with its inner surface 102 against the screen 18.

The sleeve 100 can be held onto the well component 10 in a number of ways. In one embodiment for manufacture, operators can weld the sleeve 100 to the exterior of the well component 10, for example, at the end rings or the like, for the screen 18. If the sleeve 100 is used on a slotted or perforated liner or shroud, the sleeve 100 can be affixed or welded directly to the exterior of that component.

The sleeve 100 has perforations 108, holes, openings, or the like defined all about its external surface 104. Each of these perforations 108 have plugs or plugging material 110 covering the perforations. For example, some of the plugs or plugging material 110 is shown removed from the perforations 108.

The sleeve 100 is plugged for the purpose of running in hole and deploys as an impermeable cover to the well component 10. Accordingly, flow through the screen 18 in and out of the basepipe 14 is prevented. As noted previously, this can facilitate run in and can protect the well component 10 from potential plugging.

Once downhole, the sleeve 100 becomes permeable once a reactive agent is applied to the sleeve 100 to reveal the perforations. Various types of reactive agent can be used to unplug the plugs or plugging material 110, and the choice of the reactive agent can depend on the material of the plugs or plugging material 110 and the sleeve 100. Additionally, the choice of the reactive agent can depend on what forms of delivery are available to introduce the reactive agent—e.g., either by pumping down the basepipe 14, injection by a washpipe (not shown), exposure to fluid in the borehole, etc. As noted previously, the reactive agent can include hydrochloric acid, hydrofluoric acid, or other reagents commonly used for acid stimulation. The plugging material 110 can include aluminum (or other metals) or polymeric formulations—all of which dissolve/react to the reagent.

As an alternative to having the sleeve 100 in FIG. 2C as a separate component from the shroud 28, it is possible that the shroud 28 itself can constitute part of the assembly to make the well component 10 impermeable. In this case, plugging material in the form of plugs 110, inserts, rivets, or the like can be installed in the perforations 29 of the shroud 28 in a manner similar to that disclosed above with respect to FIG. 1B, for example.

To manufacture the impermeable sleeves 100 of the present disclosure, a sheet of a first material is perforated with a plurality of perforations 108, and the perforations 108 are covered with a second material reactive to the agent. The sheet can be perforated by punching the sheet to form the perforations 108. Then, to cover the perforations 108 with the second material reactive to the agent, plugs or plugging material 110 can affix in the perforations 108.

Figure 4A:
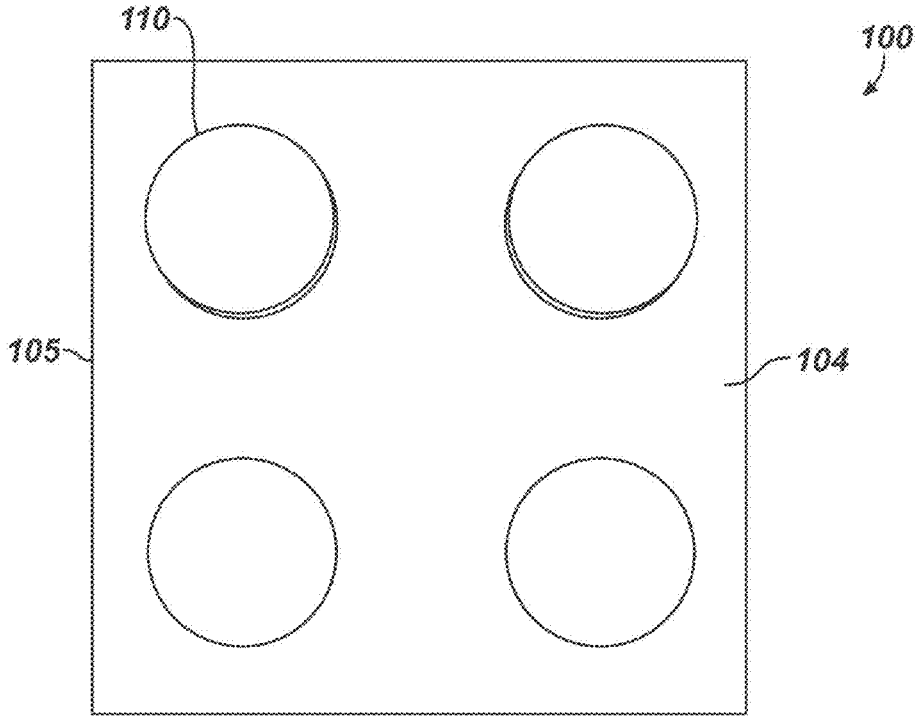
FIGS. 4A-4B illustrate a plan view and a side view of plugging material disposed in perforations of a section of the impermeable sleeve.
Figure 4B:
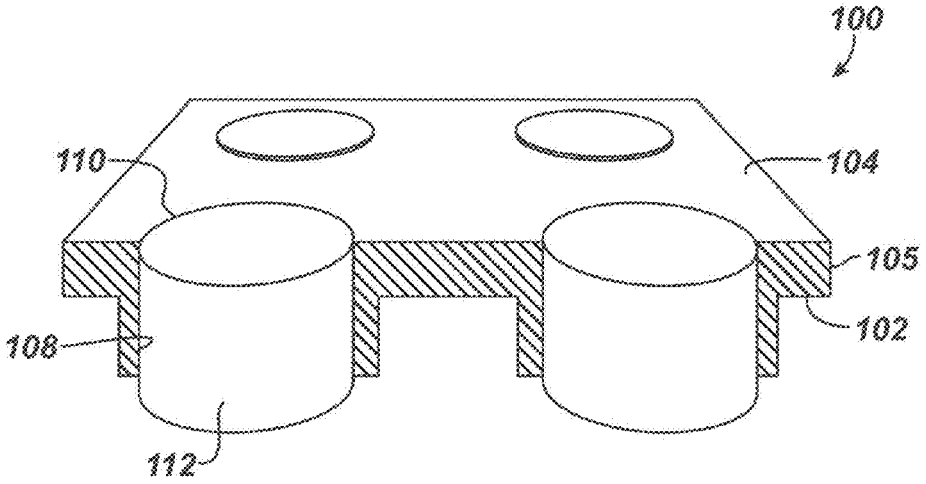

In one example as shown in FIGS. 4A-4B, the plugging material 110 can be disposed as buttons 112 in the punched perforations 108 of the perforated sleeve material 105. The punched perforations 108 can be formed in the material 105 from the external surface 104 to the internal surface 102 so that the perforations 108 extend from the internal surface 102 to help hold the plugs 112 with a friction fit.

Figure 5A:
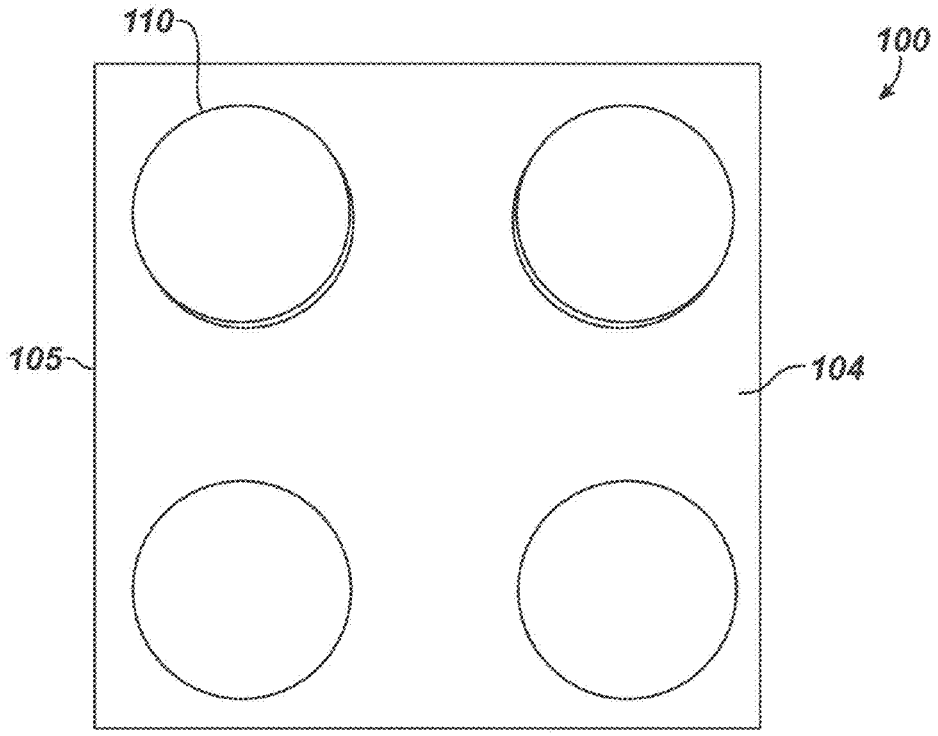
FIGS. 5A-5B illustrate a plan view and a side view of plugs disposed in perforations of a section of the impermeable sleeve.
Figure 5B:
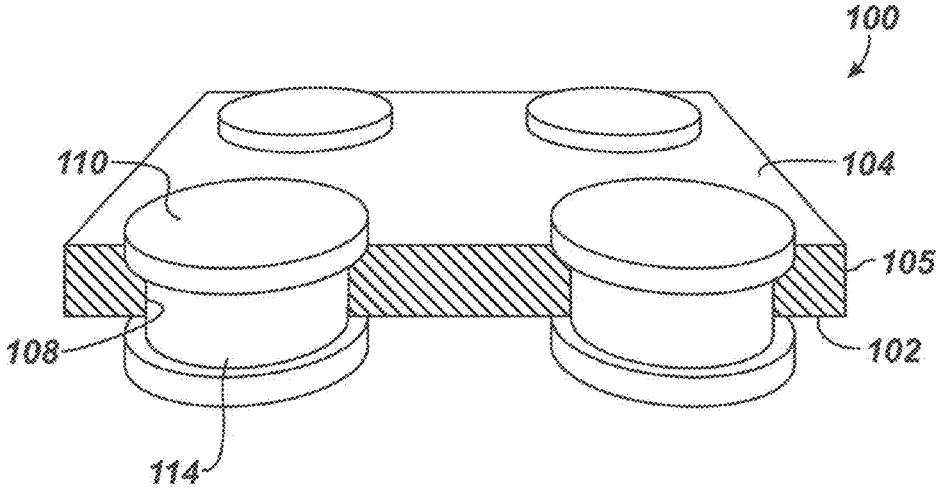

In another example as shown in FIGS. 5A-5B, the plugging material 110 can be disposed as rivets 114 in the punched perforations 108 of the perforated sleeve material 105. The punched perforations 108 can be formed flush in the material 105, and the rivets 114 can affix in the perforations 108 with shoulders, stamped ends, excess material, or the like.

To manufacture the sleeve 100, a sheet of metal material 105 is perforated with the punched perforations 108 (e.g., holes, slots, orifices, or the like). The perforations 108 are then plugged with the plugs or plugging material 110 by inserting, pressing, or fitting into the perforations 108 of the perforated sleeve 100, which acts as a carrier. Installing the plugs or plugging material 110 can be performed with a manual or automated process.

Then, the sheet material 105 for the sleeve 100 is formed into a cylinder or tubular and is welded along one or more spiral or longitudinal seam(s). Ultimately, the permeable component (10) is at least temporarily obstructed with the impermeable sleeve 100 by disposing the impermeable sleeve 100 on the permeable component 10.

It is worth noting that the plugs and plugging material 110 as depicted for the sleeve 100 in FIGS. 4A to 5B can be used in a similar fashion in the perforations of the well component, such as the perforations 17 in the pipe 14 of FIG. 1A.

Figure 6A:
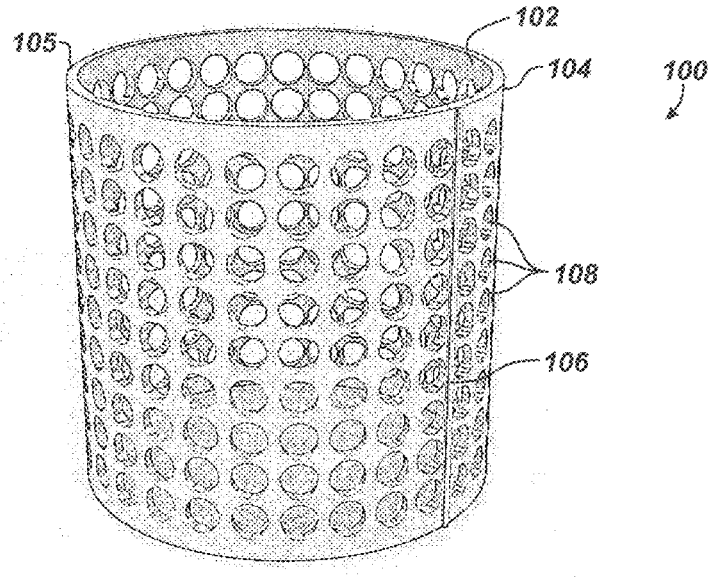
FIG. 6A illustrates a perspective view of the disclosed sleeve formed from a perforated sheet rolled into a tubular or cylinder with a weld along a longitudinal seam.
Figure 7:
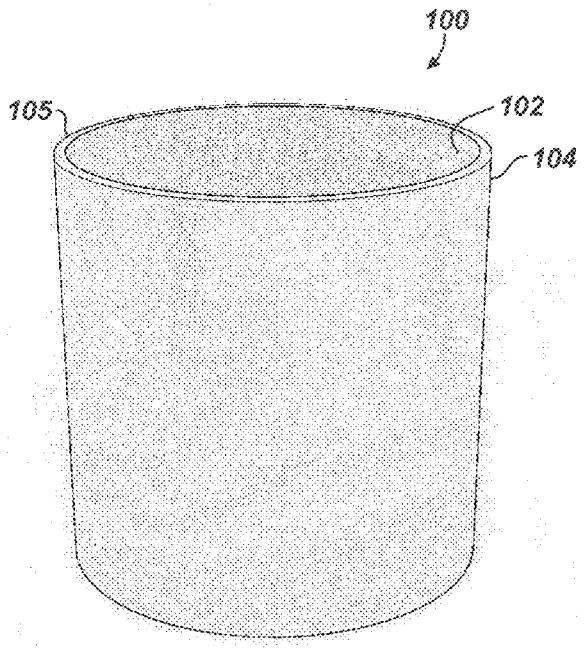
FIG. 7 illustrates a perspective view of the disclosed sleeve formed as a solid cylinder or tubular.
Figure 6B:
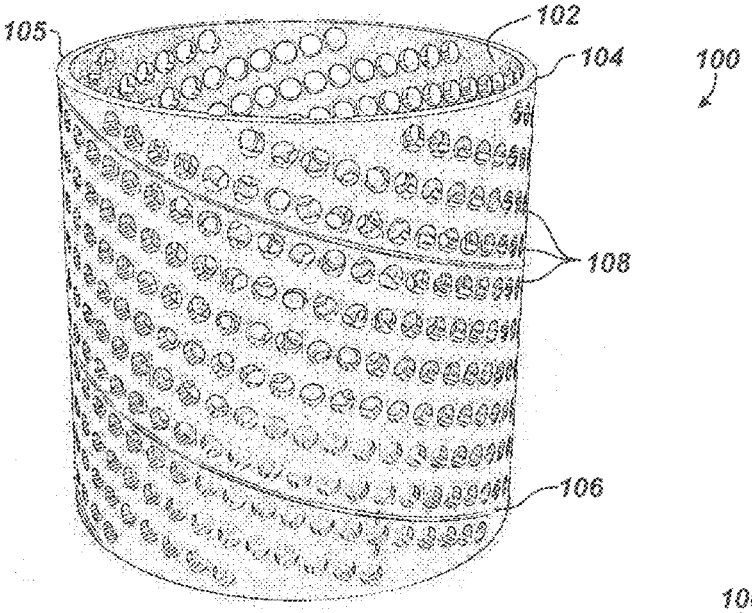
FIG. 6B illustrates a perspective view of the disclosed sleeve formed from a perforated sheet rolled into a tubular or cylinder with welds along spiraling seams.

In one arrangement, FIG. 6A illustrates a perspective view of the disclosed sleeve 100 formed from perforated sheet material 105 rolled into a tubular or cylinder with a weld along a longitudinal seam 106. In another arrangement, FIG. 6B illustrates a perspective view of the disclosed sleeve 100 formed from perforated sheet material 105 rolled into a tubular or cylinder with welds along spiraling seams 106.

Several options are available for forming the sleeve 100. For example, the sheet material 105 can first be formed into cylindrical, tubular shape of the impermeable sleeve 100, and then the impermeable sleeve 100 can be slipped on the permeable component 10. Alternatively, the sheet can be formed into the impermeable sleeve 100 while disposing the impermeable sleeve 100 on the permeable component 10.

Several options are available for covering the perforations 108. For example, the perforations 108 can be covered with the plugs or plugging material 110 before forming the sheet material 105 into the cylindrical, tubular form of the impermeable sleeve 100. Alternatively, the perforations 108 can be covered with the plugs or plugging material 110 after forming the sheet material 105 into the impermeable sleeve 100.

Figure 6C:
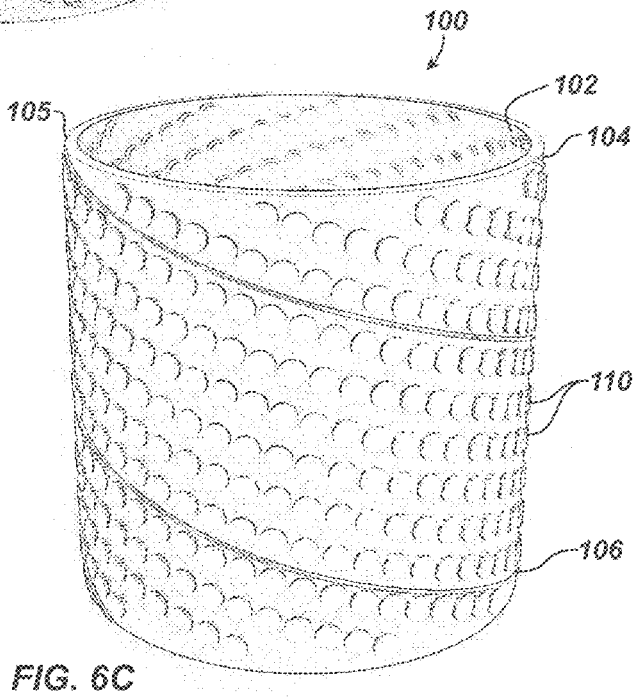
FIG. 6C illustrates a perspective view of the sleeve in FIG. 5B with plugs affixed in the perforations.

Either way may be suitable for manufacturing purposes. However, being able to cover the perforations (i.e., affix plugs in the perforation) while the sleeve material is still a sheet may be easier. Of course, any plugging done on the flat sheet material 105 must be able to withstand any further manufacturing steps of forming the sheet material 105 into the cylindrical or tubular of the sleeve 100 and welding seam(s) 106. Ultimately, the constructed sleeve 100 can resemble the sleeve in FIG. 6C with the plugs 110 affixed in the perforations 108.

In another embodiment, the sleeve 100 lacks perforations. Instead, the sleeve 100 is formed with a tubular or cylindrical form composed of a material being reactive to the agent. For example, FIG. 3B illustrates another permeable well component 10 of the present disclosure having another impermeable sleeve 100 according to the present disclosure for protective run-in.

Again, the well component 10 is a tubular body in the form of a well screen having a basepipe 14 with openings 17 communicating with the basepipe's bore 16. Wire of a wire-wrapped screen 18 is disposed about ribs 19 defining a drainage layer on the outside of the basepipe 14.

The assembly includes an impermeable sleeve 100 as an additional component to the downhole component 10. In this case, the sleeve 100 is disposed with its inner surface 102 against a protective shroud 28 for the screen 18. The sleeve 100 does not have perforations 108, holes, openings, or the like. Instead, the sleeve 100 is a solid cylinder or tubular. (FIG. 6D illustrates a perspective view of the disclosed sleeve formed as a solid cylinder or tubular.)

Figure 3B:
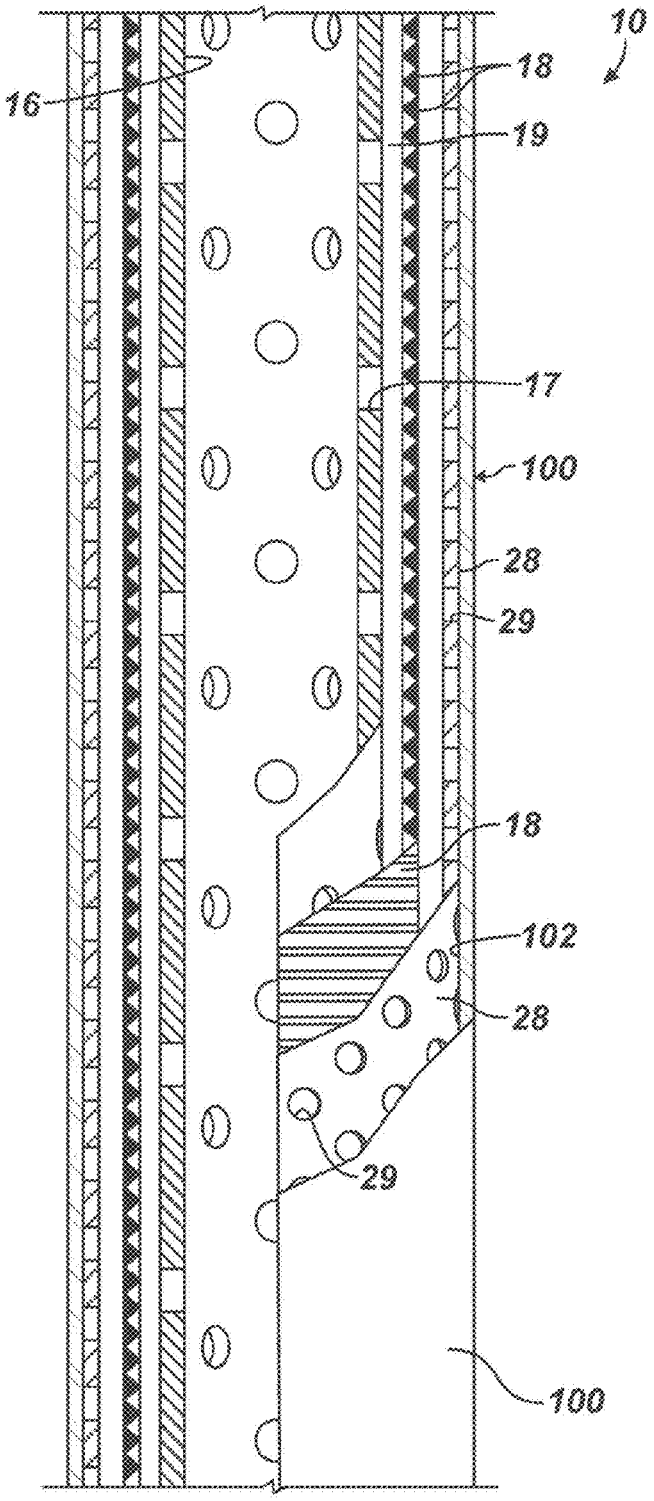

Positioned on the assembly as in FIG. 3B, the sleeve 100 plugs the shroud 28 and screen 18 for the purpose of running in hole and deploys as an impermeable cover to the well component 10. Accordingly, flow through the screen 18 in and out of the basepipe 14 is prevented. As noted previously, this can facilitate run in and can protect the well component 10 from potential plugging.

Once downhole, the sleeve 100 becomes permeable once a reactive agent is applied to the sleeve 100 to expose the openings 29 in the shroud 28. Various types of reactive agent can be used to remove all or portion of the sleeve 100, and the choice of the reactive agent can depend on the material of the sleeve 100. Additionally, the choice of the reactive agent can depend on what forms of delivery are available to introduce the reactive agent—e.g., either by pumping down the basepipe 14, injection by coil tubing (not shown), exposure to fluid in the borehole, etc.

In general, the material of the sleeve 100 can include aluminum (or other metals) or polymeric formulations—all of which dissolve/react to the reagent, such as hydrochloric acid, hydrofluoric acid, or other reagents commonly used for acid stimulation. Alternatively, the reagent may be wellbore fluid itself, and the sleeve 100 may be composed of a material, such as polyglycolide or polyglycolic acid (PGA) or the like, that dissolves/reacts to the wellbore fluid, such as the drilling fluid or the like. In this sense, the sleeve 100 may begin to dissolve/reach while running in hole, but would preferably not make the well component impermeable during the process at least until the well component is positioned.

To manufacture the impermeable sleeve 100 as such a solid cylinder or tubular, operators take a sheet of a material 105 reactive to an agent. Then, operators form the sheet material 105 into the cylinder or tubular of the impermeable sleeve 100 by welding one or more seams of the sheet material. Alternatively, the sleeve 100 can be formed as a cylinder using other manufacturing process.

Again, several options are available for forming the sleeve 100. For example, the sheet can first be formed into the impermeable sleeve 100 and can then be slipped on the permeable component 10. Alternatively, the sheet can be formed into the impermeable sleeve 100 while disposing the sleeve 100 on the permeable component 10. Either way, the permeable component 10 is at least temporarily obstructed with the impermeable sleeve 100 by disposing the impermeable sleeve 100 on the permeable component 10.

Given the above-discussion of the various embodiments of the disclosed sleeve 100, some general description of the sleeve's use downhole is briefly discussed. In use, the sleeves 100 of the present disclosure do not operate as part of the well component 10 and do not have to provide sand control or other mechanical function pertinent to the operation of the well component 10. Instead, the sleeve 100 is run as an outer layer so the assembly 10 can remain impermeable during deployment. Once the sleeve 100 has been deployed to the desired location, operators inject a reactive solution in the well or near the sleeve 100. For the perforated sleeve 100 of FIG. 3A, the reactive agent dissolves the plugs or plugging material 110 to make the sleeve 100 permeable. The reactive agent may also eat away all or part of the perforated sleeve 100. For the non-perforated sleeve 100 of FIG. 3B, the reactive agent eats away all or part of the sleeve 100 to expose the well component to the borehole.

The purpose of the sleeve 100 and/or plugs 110 is to make the well component 10 impermeable during run in operations. To meet this requirement, the sleeve 100 and/or plugs 110 are designed to withstand certain pressures during run-in. Because the sleeve 100 and plugs 110 are independent of the well component 10, the sleeve 100 and plugs 110 can be designed to meet both the impermeable function for run-in and the permeable function for sand control without compromising the sand control and mechanical characteristics of the component 10, such as wellscreen. Additionally, the sleeve 100 and/or plugs 110 can be designed for the particulars of a completion process by providing flow control and pressure holding capabilities to avoid plugging, erosion, activate downhole tools, etc. that may be performed during completion steps. Because the sleeve 100 may be thin and preferably closely enshrouding the well component 10, the sleeve 100 may not substantially alter the dimensions of the well component 10.

The sleeve 100 can be composed of a metal material that is susceptible to the reactive agent. For example, the sleeve 100 can be composed of aluminum or the like, which is susceptible to acid injected as the reactive agent. The plugs can be composed of a metal material that is susceptible to the reactive agent and may be composed of a same or different material than perforated sleeve. As one example, the plugs 110 are composed of a brass material, an aluminum material, or the like. Alternatively, the plugs 110 can be composed of a non-metallic material, such as degradable polymer, or other materials noted previously.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A method of manufacturing a well component for installation in a borehole, the method comprises:

forming the well component with a permeable portion having first perforations;

positioning a filter on the well component adjacent the first perforations;

perforating a sheet of a first material with a plurality of second perforations;

covering the second perforations with a second material reactive to an agent;

forming the sheet into an impermeable sleeve by welding one or more seams of the sheet; and obstructing at least the permeable portion of the well component at least temporarily with the impermeable sleeve by positioning the impermeable sleeve about the filter positioned adjacent the first perforations on the well component.

2. The method of claim 1, wherein perforating the sheet comprises forming the second perforations by punching the sheet.

3. The method of claim 1, wherein covering the second perforations with the second material reactive to the agent comprises at least one of:

affixing plugs of the second material in the second perforations;

riveting or threading plugs of the second material in the second perforations; and filling the second perforations with the second material.

4. The method of claim 1, wherein forming the sheet into the impermeable sleeve and positioning the impermeable sleeve about the filter positioned adjacent the first perforations on the well component comprises:

first forming the sheet into the impermeable sleeve and then slipping the impermeable sleeve about the filter positioned adjacent the first perforations on the well component; or forming the sheet into the impermeable sleeve while positioning about the filter positioned adjacent the first perforations on the well component.

5. The method of claim 1, wherein covering the second perforations with the second material reactive to the agent comprises at least one of:

covering the second perforations before forming the sheet into the impermeable sleeve; and covering the second perforations after forming the sheet into the impermeable sleeve.

6. A method of manufacturing a well component for installation in a borehole, the method comprising:

forming the well component with a permeable portion having first perforations;

positioning a filter on the well component adjacent the first perforations;

positioning a tubular shroud of a first material having second perforations about the filter;

taking a sheet of a second material reactive to an agent;

forming the sheet into an impermeable sleeve by welding one or more seams of the sheet; and obstructing at least the permeable portion of the well component at least temporarily with the impermeable sleeve by positioning the impermeable sleeve about the tubular shroud positioned on the filter on the well component.

7. The method of claim 6, wherein forming the sheet into the impermeable sleeve and positioning the impermeable sleeve about the tubular shroud positioned on the filter on the well component comprises:

first forming the sheet into the impermeable sleeve and then slipping the impermeable sleeve about the tubular shroud positioned on the filter on the well component; or forming the sheet into the impermeable sleeve while positioning the impermeable sleeve about the tubular shroud positioned on the filter on the well component.

8. The method of claim 7, further comprising:

running the well component in the borehole; and making the well component permeable by reacting the second material to the agent.

9. An apparatus for installation in a borehole, the apparatus comprising:

a well component having a through-bore and being permeable to the borehole, the well component comprising a basepipe having first perforations defined therein and having a filter disposed thereabout; and a sleeve disposed external to the filter on the well component, the sleeve being at least temporarily impermeable to obstruct the well component during run in the borehole and becoming permeable in response to an agent.

10. The apparatus of claim 9, wherein the sleeve defines a plurality of second perforations therein and has plugging material covering the second perforations, the plugging material being removable from covering the second perforations in response to the agent.

11. The apparatus of claim 10, wherein the plugging material comprises a plurality of plugs affixed in the second perforations.

12. The apparatus of claim 11, wherein the plugging material comprises an aluminum, a reactive metal, a dissolvable metal, a polymeric formulation, a polyglycolide, or a polyglycolic acid.

13. The apparatus of claim 11, wherein the plugging material is removable from covering the second perforations in response to the agent selected from the group consisting of a hydrochloric acid, a hydrofluoric acid, an acid stimulation, a wellbore fluid, and a drilling fluid.

14. The apparatus of claim 9, wherein the sleeve comprises a first shroud composed of a first material, having second perforations, and disposed about the filter; and a second shroud composed of a second material being reactive to the agent and disposed about the first shroud.

15. The apparatus of claim 14, wherein the second material comprises an aluminum, a reactive metal, a dissolvable metal, a polymeric formulation, a polyglycolide, or a polyglycolic acid.

16. The apparatus of claim 14, wherein the sleeve becomes permeable in response to the agent selected from the group consisting of a hydrochloric acid, a hydrofluoric acid, an acid stimulation, a wellbore fluid, and a drilling fluid.

* * * * *